United States Patent [19]

Ray

[11] Patent Number: 5,031,284

[45] Date of Patent: Jul. 16, 1991

[54] TIE RETAINING DEVICE

[76] Inventor: Don R. Ray, 1700 W. Cerritos #260, Anaheim, Calif. 92804

[21] Appl. No.: 513,114

[22] Filed: Apr. 23, 1990

[51] Int. Cl.[5] ..... A41D 25/12

[52] U.S. Cl. ..... 24/49 R; 24/49 CF; 24/60

[58] Field of Search ..... 24/49 R, 49 CP, 49 CF, 24/49 A, 49 TS, 55, 54, 56, 58, 60

[56] References Cited

U.S. PATENT DOCUMENTS

| | | | |
|---|---|---|---|
| 46,426 | 2/1865 | Snow | 24/60 |
| 275,876 | 4/1883 | Abbott | 24/55 |
| 287,594 | 10/1883 | Vanderbilt | 24/60 |
| 294,869 | 3/1884 | Graves | 24/60 |
| 759,680 | 5/1904 | Dancyger | 24/60 |
| 766,408 | 8/1904 | Wooley | 24/60 |
| 1,635,791 | 7/1927 | Jagemann | 24/49 A |
| 2,084,503 | 6/1937 | Rogers | 24/49 CF |
| 2,168,946 | 8/1939 | Rogers | 24/49 CF |
| 4,553,291 | 11/1985 | Carey | 24/49 R |
| 4,839,945 | 6/1989 | Price et al. | 24/49 CP |

FOREIGN PATENT DOCUMENTS

| | | | |
|---|---|---|---|
| 352064 | 5/1905 | France | 24/60 |

*Primary Examiner*—Victor N. Sakran

*Attorney, Agent, or Firm*—Charles C. Logan, II

[57] ABSTRACT

A tie retaining device that is attached to the left and right side rear fold members of a tie. The device has an elongated wire-like member having pointed tips on each of its ends for penetrating the rear fold members of the tie. A tethering chain has its one end attached to the wire-like member and its other end attached to a button-hole anchor bar that is detachably inserted into the button hole of a shirt. The wire-like member may take various configurations.

3 Claims, 1 Drawing Sheet

TIE RETAINING DEVICE

BACKGROUND OF THE INVENTION

The Invention relates to ties and more specifically to a device for keeping the tie from flopping loosely away from the wearer's shirt.

Presently most men that wear ties do not use retaining devices to keep the tie from flopping around. When they do wear a retaining device it is usually a tie tack or a tie bar. The disadvantage to using the tie tack is it requires that the user put the pin of the tack through the fabric of the tie. This is not a desirable system to use when the tie is of expensive delicate fabric. The tie bars are not entirely satisfactory since they usually work themselves loose and often appear at an angle that is cocked with respect to the desired horizontal position.

It is an object of the invention to provide a novel tie retaining device that does not require puncturing the fabric of the tie in order to make it operational.

It is also an object of the invention to provide a novel tie retaining device that is entirely hidden from view behind the tie.

It is another object of the invention to provide a novel tie retaining device that is easily installed and removed from the rear of the tie.

It is an additional object of the invention to provide a novel tie retaining device that is economical to manufacture and market.

SUMMARY OF THE INVENTION

Applicant's novel tie retaining device has been designed to be attached to the right and left side rear fold members of a tie. This allows it to be completely hidden from view. Also since the tie retaining device requires puncturing the fabric of the tie, the device only punctures an area of the tie that is not visable to viewing.

The tie retaining device has as its basic component an elongated wire-like member having predetermined length that spans the width of the tie tail. The wire-like member has pointed tips formed on its opposite ends that penetrate the fabric of the left and right side rear fold members of the tie. A tethering chain has its one end connected to the wire-like member and its other end is connected to a button-hole anchor bar. The button-hole anchor bar is inserted into one of the button holes of the wearer's shirt.

The wire-like member may take many various configurations but they all function in the same manner.

DESCRIPTION OF THE PREFERRED EMBODIMENT

Figure 1:
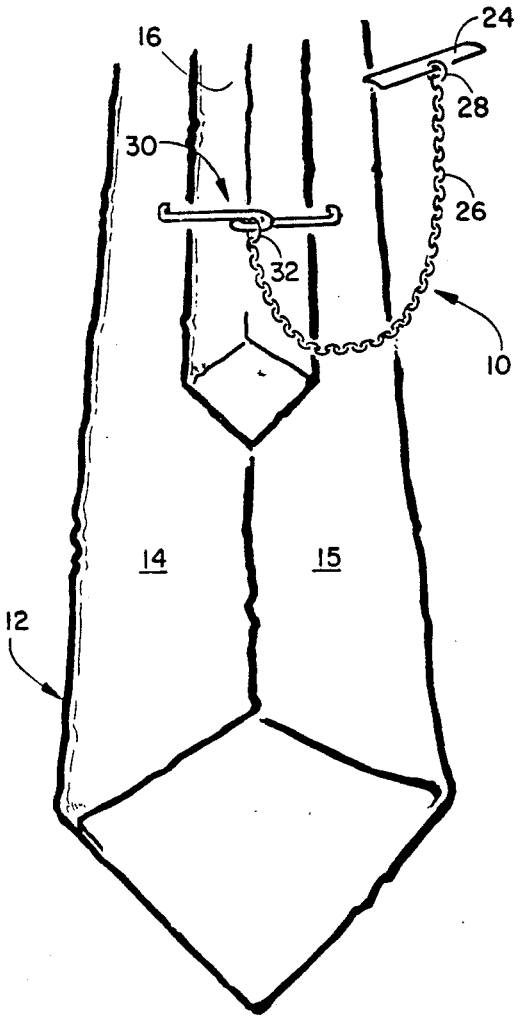
FIG. 1 is a rear elevation view of a portion of a tie showing the manner in which the tie retaining device is attached thereto.

Applicant's novel tie retaining device will now be described by referring to FIGS. 1–7 if the drawing. The tie retaining device is generally designated 10.

Figure 2:
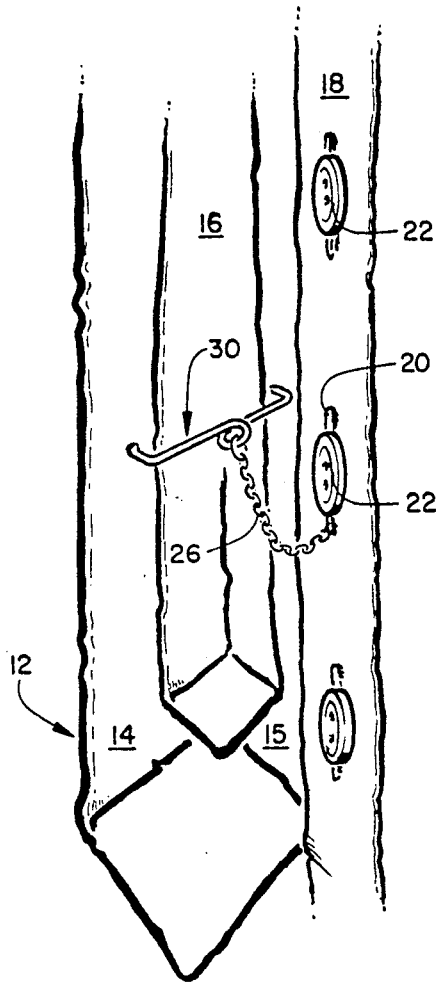
FIG. 2 is a perspective view illustrating how the tie retaining device is attached to the button-hole of the shirt of the wearer.

In FIGS. 1 and 2 the tie retaining device 10 is illustrated in the manner in which it is attached to a tie 12. The tie has a left side fold member 14 and a right side fold member 15. It has a tie tail 16. Shirt 18 has a plurality of button holes 20 and buttons 22. Button-hole anchor bar 24 is attached to tethering chain 26 by a ring 28. Button-hole anchor bar 24 is detachably inserted into one of the button holes 20. The other end of tethering chain 26 is attached to wire-like member 30 by a ring 32.

Figure 3:
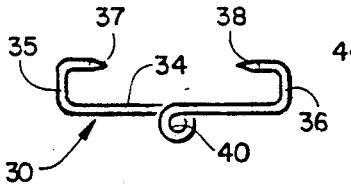
FIG. 3 is a top plan view of the wire-like member illustrated in FIGS. 1 and 2.

The specific structure of wire member 30 is illustrated in FIG. 3. It has a longitudinally extending member 34 having a right angularly shape finger 35 formed at its left end and a right angularly shaped finger 36 formed at its right end. These fingers respectively have pointed tips 37 and 38. A loop 40 is formed intermediate the ends of longitudinally extending member 34.

Figure 4:
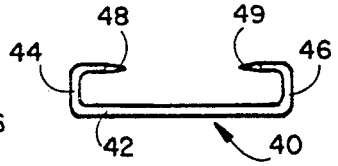
FIG. 4 is a first alternative embodiment of the wire-like member.

A first alternative embodiment 40 is illustrated in FIG. 4. It has a longitudinally extending member 42. Right angularly shaped fingers 44 and 46 are formed at its opposite ends. These fingers have respectively, pointed tips 48 and 49.

Figure 5:
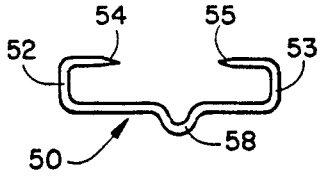
FIG. 5 is a second alternative embodiment of the wire-like member.

A second alternative embodiment of the wire-like member 50 is illlustrated in FIG. 5. It has a longitudinally extending member 51 having right angularly shaped fingers 52 and 53 formed at its respective ends. Pointed tips 54 and 55 are formed at the ends of each of the respective fingers. A laterally offset curved portion 58 is formed intermediate the ends of longitudinally extending member 51.

Figure 6:
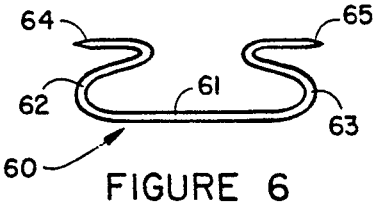
FIG. 6 is a third alternative embodiment of the wire-like member.

A third alternative embodiment wire-like member 60 is illustrated in FIG. 6. It has a longitudinally extending member 61 having serpentine shaped fingers 62 and 63 formed at its opposite ends. These fingers have pointed tips 64 and 65 at their ends.

Figure 7:
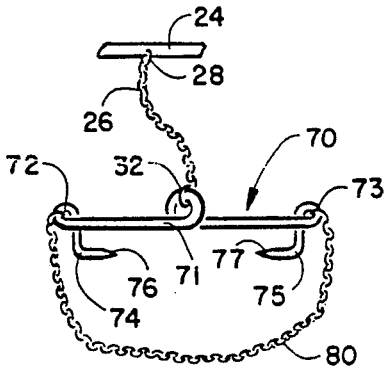
FIG. 7 illustrates a fourth alternative embodiment of the elongated wire-like member.

In FIG. 7, a fourth alternative embodiment wire-like member 70 is illustrated. It has a longitudinally extending member 71 having loops 72 and 73 formed at its opposite ends. Right angularly shaped fingers 74 and 75 are integrally formed on these loops. The fingers have pointed tips 76 and 77 at their ends. A decorative chain has its opposite ends connected to the respective loops 72 and 73.

What is claimed is:

1. A tie retaining device comprising:

an elongated wire-like member having a predetermined length and having a left end and a right end;

said elongated wire-like member has a loop integrally formed therein intermediate its left and right ends;

said elongated wire-like member has integrally formed loops at its respective left and right ends;

a right angularly shaped finger integrally formed on the left end of said wire-like member, said finger having a pointed tip for penetrating the rear fold member of a tie;

a right angularly shaped finger integrally formed on the right end of said wire-like member, said finger having a pointed tip for penetrating the rear fold member of a tie;

a button-hole anchor bar;

an elongated tethering chain having a first and a second end;

means connecting the first end of said tethering chain to said button-hole anchor bar; and means connecting the second end of said tethering chain to the loop of said wire-like member intermediate its ends.

2. A tie retaining device as recited in claim 1 further comprising an elongated decorative chain having its opposite ends connected to the respective left and right end loops.

3. A tie retaining device comprising:

an elongated wire-like member having a predetermined length and having a left end and a right end;

said elongated wire-like member has a loop integrally formed therein intermediate its left and right ends;

a right angularly shaped finger integrally formed on the left end of said wire-like member, said finger having a pointed tip for penetrating the rear fold member of a tie;

a right angularly shaped finger integrally formed on the right end of said wire-like member, said finger having a pointed tip for penetrating the rear fold member of a tie;

said elongated wire-like member, its two right angularly shaped fingers, and its loop are all oriented in substantially the same horizontal plane;

a button-hole anchor bar;

an elongated tethering chain having a first and a second end;

means connecting the first end of said tethering chain to said button-hole anchor bar; and means connecting the second end of said tethering chain to the loop of said wire-like member intermediate its ends.

* * * * *